US010508521B2

(12) United States Patent
Shammari et al.

(10) Patent No.: US 10,508,521 B2
(45) Date of Patent: Dec. 17, 2019

(54) ITERATIVE METHOD FOR ESTIMATING PRODUCTIVITY INDEX (PI) VALUES IN MAXIMUM RESERVOIR CONTACT (MRC) MULTILATERAL COMPLETIONS

(71) Applicant: Saudi Arabian Oil Company, Dhahran (SA)

(72) Inventors: Ahmad T. Shammari, Khobar (SA); Hassan A. Hussain, Al Hasa (SA); Obiomalotaoso L. Isichei, Dhahran (SA); Bayan A. Momtan, Sammam (SA)

(73) Assignee: Saudi Arabian Oil Company, Dhahran (SA)

( * ) Notice: Subject to any disclaimer, the term of this patent is extended or adjusted under 35 U.S.C. 154(b) by 283 days.

(21) Appl. No.: 15/614,203

(22) Filed: Jun. 5, 2017

(65) Prior Publication Data

US 2018/0347326 A1 Dec. 6, 2018

(51) Int. Cl.

| | |
|---|---|
| ***E21B 43/12*** | (2006.01) |
| ***E21B 49/08*** | (2006.01) |
| ***E21B 41/00*** | (2006.01) |
| ***E21B 44/00*** | (2006.01) |

(52) U.S. Cl.

CPC ..... *E21B 43/12* (2013.01); *E21B 41/0035* (2013.01); *E21B 44/005* (2013.01); *E21B 49/087* (2013.01)

(58) Field of Classification Search

CPC .... E21B 43/12; E21B 49/087; E21B 41/0035; E21B 44/005

See application file for complete search history.

(56) References Cited

U.S. PATENT DOCUMENTS

| | | | |
|---|---|---|---|
| 5,305,209 | A | 4/1994 | Stein et al. |
| 5,871,047 | A | 2/1999 | Spath et al. |
| 7,089,167 | B2 | 8/2006 | Poe |
| 7,266,456 | B2 | 9/2007 | De Guzman et al. |
| 7,725,302 | B2 | 5/2010 | Ayan et al. |
| 8,244,509 | B2 | 8/2012 | Banerjee et al. |
| 8,463,585 | B2 | 6/2013 | Sun et al. |

(Continued)

FOREIGN PATENT DOCUMENTS

| | | |
|---|---|---|
| CN | 204002774 | 12/2014 |
| WO | 0229195 A2 | 4/2002 |

OTHER PUBLICATIONS

Cetkovic et al., "A methodology for Multilateral Wells Optimization—Field Case Study", SPE-183004-MS, Society of Petroleum Engineers, 2016, pp. 1-18.

(Continued)

*Primary Examiner* — Wei Wang

(74) *Attorney, Agent, or Firm* — Bracewell LLP; Constance G. Rhebergen; Brian H. Tompkins

(57) ABSTRACT

A process for determining the productivity index of a multilateral completion using data from individual laterals and data from commingled well tests is disclosed. The process includes 1) determining the productivity index for each single lateral by iteratively altering the productivity index until the individual lateral flowrate based on a known reservoir pressure is matched and 2) further determining the productivity index by iteratively altering the productivity index until the commingled flowrate is matched. The productivity index may be used to set wellhead pressures and inline control valve (ICV) settings for production.

20 Claims, 7 Drawing Sheets

(56) References Cited

U.S. PATENT DOCUMENTS

| | | | |
|---|---|---|---|
| 8,620,636 | B2 | 12/2013 | Zhan et al. |
| 8,788,209 | B2 | 7/2014 | Foot et al. |
| 9,026,417 | B2 | 5/2015 | Sequeira, Jr. et al. |
| 9,489,755 | B2 | 11/2016 | Ewing et al. |
| 2015/0371345 | A1 | 12/2015 | Jeffers |
| 2016/0319655 | A1 | 11/2016 | Awadh et al. |
| 2016/0328497 | A1 | 11/2016 | Hamza et al. |

OTHER PUBLICATIONS

International Search Report and Written Opinion for related PCT application PCT/US2018/035938; International Filing date Jun. 5, 2018; Report dated Oct. 8, 2018; pp. 1-12.

Salas, J.R., et al.; "Multilateral Well Performance Prediction" SPE 35711, Society of Petroleum Engineers Western Regional Meeting, Anchorage, AK, May 22-24, 1996, pp. 591-607.

400

| | | 402 DESCRIPTION | 404 MB ICV | 406 L2 ICV | 408 L3 ICV | |
|---|---|---|---|---|---|---|
| CLEAR | RUN | CURRENT | (%) | (%) | (%) | |
| | | | 100 | 100 | 100 | 410 |
| CLEAR | RUN | TOGGLE 33% ON ONE ICV | 33 | 100 | 100 | |
| | | | 100 | 33 | 100 | 412 |
| | | | 100 | 100 | 33 | |
| CLEAR | RUN | TOGGLE 33% ON TWO ICVS | 33 | 33 | 100 | |
| | | | 100 | 33 | 33 | 414 |
| | | | 33 | 100 | 33 | |
| CLEAR | RUN | SHUT MB AND RUN ALL ICV COMBINATIONS | 0 | 100 | 100 | |
| | | | 0 | 33 | 100 | |
| | | | 0 | 100 | 33 | 416 |
| | | | 0 | 33 | 33 | |
| CLEAR | RUN | SHUT LAT 1 AND RUN ALL ICV COMBINATIONS | 100 | 0 | 100 | |
| | | | 33 | 0 | 100 | |
| | | | 100 | 0 | 33 | 418 |
| | | | 33 | 0 | 33 | |
| CLEAR | RUN | SHUT LAT 2 AND RUN ALL ICV COMBINATIONS | 100 | 100 | 0 | |
| | | | 33 | 100 | 0 | |
| | | | 100 | 33 | 0 | 420 |
| | | | 33 | 33 | 0 | |
| CLEAR | RUN | DEFINE SPECIFIC CASE | 100 | 100 | 5.29 | 422 |

FIG. 4

500

| | 502 DESCRIPTION | 504 MB ICV | 506 L2 ICV | 508 L3 ICV | 510 WELL OIL | 512 WELL GOR | 514 WELL WC | 516 MB OIL | 518 L1 OIL | 520 L2 OIL | 522 MB GOR | 524 L1 GOR | 526 L2 GOR |
|---|---|---|---|---|---|---|---|---|---|---|---|---|---|
| | | (%) | (%) | (%) | (STB/d) | (SCF/STB) | (%) | (STB/d) | (STB/d) | (STB/d) | (SCF/STB) | (SCF/STB) | (SCF/STB) |
| 528 | CURRENT | 100 | 100 | 100 | | | | | | | | | |
| 530 | TOGGLE 33% ON ONE ICV | 33 | 100 | 100 | | | | | | | | | |
| | | 100 | 33 | 100 | | | | | | | | | |
| | | 100 | 100 | 33 | | | | | | | | | |
| 532 | TOGGLE 33% ON TWO ICVS | 33 | 33 | 100 | | | | | | | | | |
| | | 100 | 33 | 33 | | | | | | | | | |
| | | 33 | 100 | 33 | | | | | | | | | |
| 534 | SHUT MB AND RUN ALL ICV COMBINATIONS | 0 | 100 | 100 | | | | | | | | | |
| | | 0 | 33 | 100 | | | | | | | | | |
| | | 0 | 100 | 33 | | | | | | | | | |
| | | 0 | 33 | 33 | | | | | | | | | |
| 536 | SHUT LAT 1 AND RUN ALL ICV COMBINATIONS | 100 | 0 | 100 | | | | | | | | | |
| | | 33 | 0 | 100 | | | | | | | | | |
| | | 100 | 0 | 33 | | | | | | | | | |
| | | 33 | 0 | 33 | | | | | | | | | |
| 538 | SHUT LAT 2 AND RUN ALL ICV COMBINATIONS | 100 | 100 | 0 | | | | | | | | | |
| | | 33 | 100 | 0 | | | | | | | | | |
| | | 100 | 33 | 0 | | | | | | | | | |
| | | 33 | 33 | 0 | | | | | | | | | |
| 540 | DEFINE SPECIFIC CASE | 100 | 100 | 5.29 | | | | | | | | | |

FIG. 5

600

| | |
|---|---|
| SEPARATOR NAME | SHYB_GOSP |
| WELL NAME | SHYB_398 |
| NO OF LATERALS | 2 |
| MOTHERBORE NAME | 398_MB |
| LATERAL 1 NAME | 398_L1 |
| LATERAL 2 NAME | 398_L2 |

606

| MAX OIL | MAX GAS | MAX WATER | WHP |
|---|---|---|---|
| (STB/d) | (SCF/STB) | (STB/d) | psig |
| 5200 | | | 1400 |

602

SET CONTRAINTS IN GAP (STEP 1) 610

3-1/2" 2-7/8"

RUN ALL (STEP 2) 608

500

| | | 502 DESCRIPTION | 504 MB ICV | 506 L2 ICV | 508 L3 ICV | 510 WELL OIL | 512 WELL GOR | 514 WELL WC | 516 MB OIL | 518 L1 OIL | 520 L2 OIL | 522 MB GOR | 524 L1 GOR |
|---|---|---|---|---|---|---|---|---|---|---|---|---|---|
| | | | (%) | (%) | (%) | (STB/d) | (SCF/STB) | (%) | (STB/d) | (STB/d) | (STB/d) | (SCF/STB) | (SCF/STB) |
| CLEAR RUN | 528 | CURRENT | 100 | 100 | 100 | 5135 | 1898 | 0 | 454 | 585 | 4086 | 1495 | 800 |
| CLEAR RUN | 530 | TOGGLE 33% ON ONE ICV | 33 | 100 | 100 | 5130 | 1890 | 0 | 476 | 604 | 4050 | 1495 | 800 |
| | | | 100 | 33 | 100 | 5135 | 1593 | 0 | 487 | 611 | 4087 | 1495 | 800 |
| | | | 100 | 100 | 33 | 5040 | 1659 | 0 | 572 | 725 | 3742 | 1495 | 800 |
| CLEAR RUN | 532 | TOGGLE 33% ON TWO ICVS | 33 | 33 | 100 | 5182 | 1690 | 0 | 490 | 519 | 4050 | 1495 | 800 |
| | | | 100 | 33 | 33 | 5048 | 1650 | 0 | 573 | 722 | 3751 | 1495 | 800 |
| | | | 33 | 100 | 33 | 5065 | 1656 | 0 | 579 | 741 | 3745 | 1495 | 800 |
| CLEAR RUN | 534 | SHUT MB AND RUN ALL ICV COMBINATIONS | 0 | 100 | 100 | 5110 | 1794 | 0 | 0 | 417 | 4592 | 0 | 800 |
| | | | 0 | 33 | 100 | 5067 | 1755 | 0 | 0 | 414 | 4583 | 0 | 800 |
| | | | 0 | 100 | 33 | 4942 | 1717 | 0 | 0 | 625 | 4315 | 0 | 800 |
| | | | 0 | 33 | 33 | 4951 | 1718 | 0 | 0 | 623 | 4328 | 0 | 800 |
| CLEAR RUN | 536 | SHUT LAT 1 AND RUN ALL ICV COMBINATIONS | 100 | 0 | 100 | 5072 | 1782 | 0 | 1019 | 0 | 4252 | 1495 | 0 |
| | | | 33 | 0 | 100 | 5256 | 1782 | 0 | 1015 | 0 | 4251 | 1495 | 0 |
| | | | 100 | 0 | 33 | 5142 | 1758 | 0 | 1189 | 0 | 3953 | 1495 | 0 |
| | | | 33 | 0 | 33 | 5159 | 1771 | 0 | 1155 | 0 | 4000 | 1495 | 0 |
| CLEAR RUN | 538 | SHUT LAT 2 AND RUN ALL ICV COMBINATIONS | 100 | 100 | 0 | 1472 | 1154 | 0 | 770 | 690 | 0 | 1495 | 800 |
| | | | 33 | 100 | 0 | 1398 | 1130 | 0 | 556 | 723 | 0 | 1495 | 800 |
| | | | 100 | 33 | 0 | 1410 | 1144 | 0 | 590 | 704 | 0 | 1495 | 800 |
| | | | 33 | 33 | 0 | 1378 | 1127 | 0 | 541 | 720 | 0 | 1495 | 800 |
| CLEAR RUN | 540 | DEFINE SPECIFIC CASE | 100 | 100 | 5.29 | 3051 | 1396 | 0 | 591 | 1147 | 1310 | 1495 | 800 |

FIG. 6

ITERATIVE METHOD FOR ESTIMATING PRODUCTIVITY INDEX (PI) VALUES IN MAXIMUM RESERVOIR CONTACT (MRC) MULTILATERAL COMPLETIONS

BACKGROUND

Field of the Disclosure

Embodiments of the disclosure generally relate to multilateral wells and, more specifically, determining the production capabilities of multilateral completions.

Description of the Related Art

In the recovery of hydrocarbons from subterranean formations having hydrocarbon-bearing reservoirs, wellbores are drilled with multiple highly deviated or horizontal portions that extend through separate hydrocarbon-bearing production zones. Such "multilateral wells" include branches or laterals from a motherbore that extend into the separate hydrocarbon-bearing production zones. Multilateral well have increased in importance during the past decade and may be used for hydrocarbon production from "tight" reservoirs.

As result of the increasing use of multilateral wells, multilateral well modeling and performance prediction techniques have become increasingly important for a variety of purposes. Such techniques are used by production engineers to determine the wellhead pressures and inflow control valve (ICV) settings to achieve specific production flowrates. Multilateral well modeling and performance prediction may be particularly challenging due to the interplay between branches or laterals and pressure drop behaviors.

SUMMARY

Various multilateral well models have been developed and used in multilateral well modeling and performance prediction. These models may be categorized into two groups: numeric models and analytic models. Numeric models use detailed simulation that accounts for reservoir heterogeneity, multiphase flow, and the interplay of laterals. In contrast to the numeric models, analytic models provide of a more rapid assessment of well performance using general equations.

Existing numeric models are inefficient and time-consuming when used for production engineering purposes. Existing analytic models simply calculate the sum of productivity of the individual branches or laterals of a multilateral well; however, this approach is rarely accurate and does not accurately capture the interplay between branches or laterals. The existing approaches fail to properly evaluate the competition effects of inflow performance and interface effects of commingled production.

In one embodiment, a method is provided for determining the productivity of a multilateral completion having a plurality of laterals. The method includes determining a plurality of initial productivity indices associated with the plurality of laterals and a plurality of well tests. Each of the plurality of well tests is associated with a set of well test conditions that include a wellhead pressure and a well test flowrate. The method further includes determining a respective plurality of intermediate productivity indices associated with the plurality of laterals. Determining the intermediate productivity index associated with a selected lateral of the plurality of laterals includes determining, for each of the plurality of well tests, a modeled flowrate for the selected lateral using the well test conditions associated with a first selected well test, iteratively modifying, for each of the plurality of well tests, the initial productivity index associated with the selected lateral until the well test flowrate of the first selected well test matches the modeled flowrate, and determining the intermediate productivity index associated with the selected lateral from an average of the modified initial productivity index for each of the plurality of well tests. The method further includes determining a respective plurality of final productivity indices associated with the plurality of laterals. Determining the final productivity index for the selected lateral includes determining, for each of a second plurality of well tests, a modeled commingled flowrate using the respective plurality of intermediate productivity indices associated with the plurality of laterals and the well test conditions associated with a second selected well test, iteratively reducing, for each of the second plurality of well tests, the respective intermediate productivity index for each of the plurality laterals by an identical percentage until a well test commingled flowrate of the second selected well test matches the modeled commingled flowrate, and determining the final productivity index for the selected lateral from an average of the reduced intermediate productivity index for each of the plurality of well tests.

In some embodiments, the method includes adjusting a wellhead pressure of a wellhead associated with the multilateral completion based on one or more of the respective plurality of final productivity indices for the plurality of laterals. In some embodiments, the multilateral completion includes a plurality of inline control valves and the method includes adjusting at least one of the plurality of inline control valves based on one or more of the respective plurality of final productivity indices for the plurality of laterals. In some embodiments, the well test conditions include a reservoir pressure of the multilateral completion and a vertical flow correlation of the multilateral completion. In some embodiments, the method includes generating a network model of the multilateral completion, such that the modeled commingled flowrate is determined from the network model. In some embodiments, the method includes determining, for each of the plurality of well tests, the modeled flowrate for the selected one of the plurality of laterals includes masking the unselected laterals of the plurality of laterals in the network model such that the unselected laterals do not contribute to the modeled flowrate determination.

In another embodiment, a system is provided that includes determining the productivity of a multilateral completion having a plurality of laterals. The system includes a productivity index processor and a non-transitory computer-readable memory accessible by the productivity index processor, the memory having executable code stored thereon. The executable code includes a set of instructions that causes the processor to perform operations that include determining a plurality of initial productivity indices associated with the plurality of laterals and a plurality of well tests. Each of the plurality of well tests is associated with a set of well test conditions that include a wellhead pressure and a well test flowrate. The operations further include determining a respective plurality of intermediate productivity indices associated with the plurality of laterals. Determining the intermediate productivity index associated with a selected lateral of the plurality of laterals includes determining, for each of the plurality of well tests, a modeled flowrate for the selected lateral using the well test conditions associated with a first selected well test, iteratively modifying, for each of the plurality of well tests, the initial productivity index associated with the selected lateral until the well test flowrate of the first selected well test matches the modeled flowrate, and determining the intermediate productivity index associated with the selected lateral from an average of the modified initial productivity index for each of the plurality of well tests. The operations further include determining a respective plurality of final productivity indices associated with the plurality of laterals. Determining the final productivity index for the selected lateral includes determining, for each of a second plurality of well tests, a modeled commingled flowrate using the respective plurality of intermediate productivity indices associated with the plurality of laterals and the well test conditions associated with a second selected well test, iteratively reducing, for each of the second plurality of well tests, the respective intermediate productivity index for each of the plurality laterals by an identical percentage until a well test commingled flowrate of the second selected well test matches the modeled commingled flowrate, and determining the final productivity index for the selected lateral from an average of the reduced intermediate productivity index for each of the plurality of well tests.

In some embodiments, the system includes the multilateral completion. In some embodiments, the multilateral completion includes a plurality of inline control valves and a wellhead. In some embodiments, the wellhead pressure of the wellhead is adjusted based on one or more of the respective plurality of final productivity indices for the plurality of laterals. In some embodiments, at least one of the plurality of inline control valves based on one or more of the respective plurality of final productivity indices for the plurality of laterals. In some embodiments, the well test conditions include a reservoir pressure of the multilateral completion and a vertical flow correlation of the multilateral completion. In some embodiments, the operations include generating a network model of the multilateral completion, such that the modeled commingled flowrate is determined from the network model. In some embodiments, determining, for each of the plurality of well tests, the modeled flowrate for the selected one of the plurality of laterals includes masking the unselected laterals of the plurality of laterals in the network model such that the unselected laterals do not contribute to the modeled flowrate determination.

In another embodiment, a non-transitory computer-readable medium having executable code stored thereon for or determining the productivity of a multilateral completion having a plurality of laterals is provided. The executable code has a set of instructions that causes a processor to perform operations that include determining a plurality of initial productivity indices associated with the plurality of laterals and a plurality of well tests. Each of the plurality of well tests is associated with a set of well test conditions that include a wellhead pressure and a well test flowrate. The operations further include determining a respective plurality of intermediate productivity indices associated with the plurality of laterals. Determining the intermediate productivity index associated with a selected lateral of the plurality of laterals includes determining, for each of the plurality of well tests, a modeled flowrate for the selected lateral using the well test conditions associated with a first selected well test, iteratively modifying, for each of the plurality of well tests, the initial productivity index associated with the selected lateral until the well test flowrate of the first selected well test matches the modeled flowrate, and determining the intermediate productivity index associated with the selected lateral from an average of the modified initial productivity index for each of the plurality of well tests. The operations further include determining a respective plurality of final productivity indices associated with the plurality of laterals. Determining the final productivity index for the selected lateral includes determining, for each of a second plurality of well tests, a modeled commingled flowrate using the respective plurality of intermediate productivity indices associated with the plurality of laterals and the well test conditions associated with a second selected well test, iteratively reducing, for each of the second plurality of well tests, the respective intermediate productivity index for each of the plurality laterals by an identical percentage until a well test commingled flowrate of the second selected well test matches the modeled commingled flowrate, and determining the final productivity index for the selected lateral from an average of the reduced intermediate productivity index for each of the plurality of well tests.

In some embodiments, the well test conditions include a reservoir pressure of the multilateral completion and a vertical flow correlation of the multilateral completion. In some embodiments, the operations include generating a network model of the multilateral completion, such that the modeled commingled flowrate is determined from the network model. In some embodiments, determining, for each of the plurality of well tests, the modeled flowrate for the selected one of the plurality of laterals includes masking the unselected laterals of the plurality of laterals in the network model such that the unselected laterals do not contribute to the modeled flowrate determination. In some embodiments, the multilateral completion includes a plurality of inline control valves and a wellhead. In some embodiments, the operations include providing a graphical user interface on a display coupled to the processor, the graphical user interface includes a user interface element that includes the final productivity index.

BRIEF DESCRIPTION OF THE DRAWINGS

FIGS. 4-6 are schematic diagrams of elements of such a graphical user interface illustrating an example implementation of a process for determining the productivity indices for laterals of a multilateral completion in accordance with an embodiment of the disclosure.

DETAILED DESCRIPTION

Figure 1:
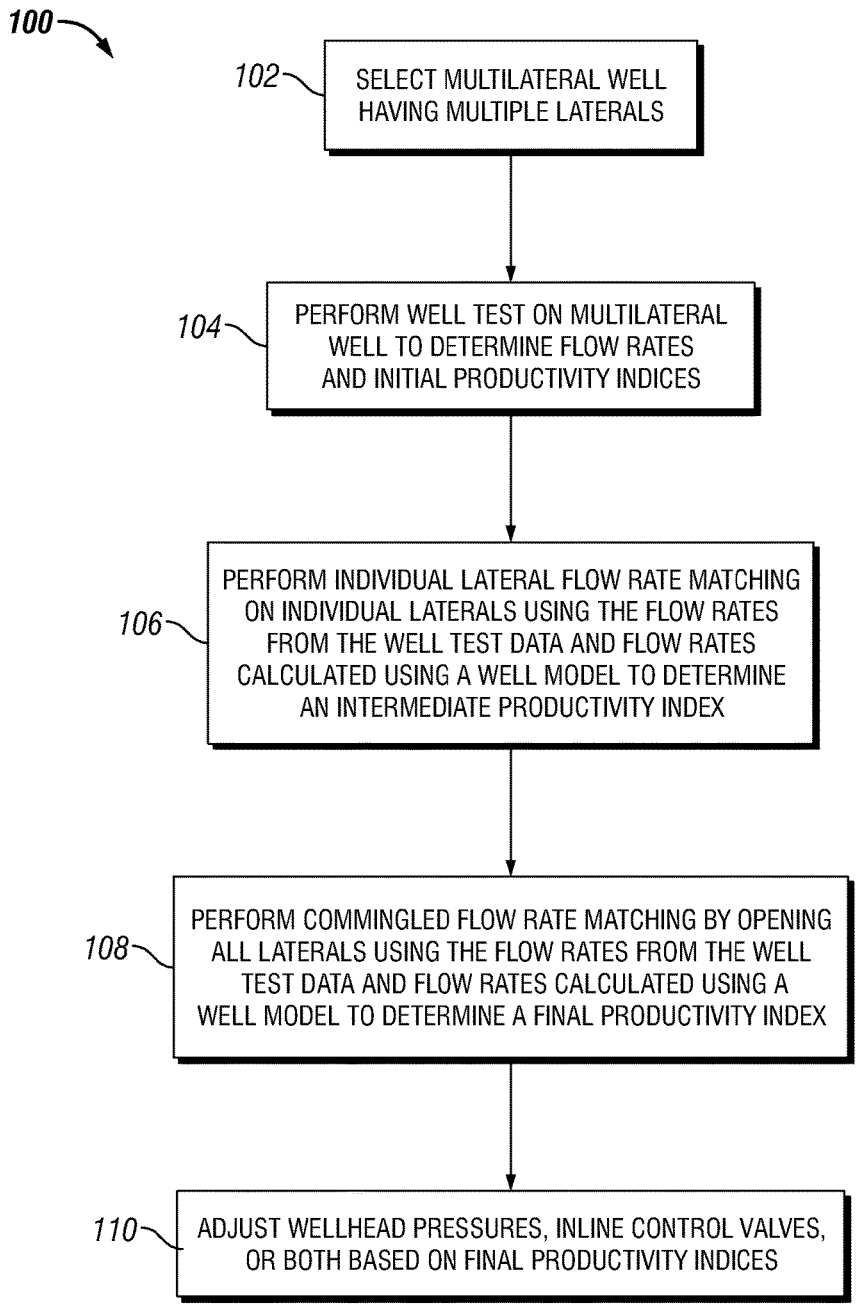
FIG. 1 is a block diagram of a process for determining the productivity indices for laterals of a multilateral completion in accordance with an embodiment of the disclosure.

The present disclosure will now be described more fully hereinafter with reference to the accompanying drawings, which illustrate embodiments of the disclosure. This disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art.

The performance of individual laterals of a multilateral well may be determined by a productivity index (PI). A productivity index model for a lateral may be determined by Equation 1:

$$q_n = J_n(\bar{P}_n - P_{wf_n}) \quad (1)$$

Where $q_n$ is the production flowrate from lateral n, J is the productivity index for lateral n, $\bar{P}_n$ is the average reservoir pressure for lateral n and $P_{wf_n}$ is the wellbore flowing pressure for lateral n. The productivity index may be calculated based on reservoir description parameters or empirically correlated based on well test results. As used herein, the term "well test" refers to the measurement of stabilized flowrate and wellbore flowing pressure under a specific wellhead pressure. Well test conditions such as wellhead pressure, reservoir pressure, and vertical flow correlation may be used in the model and then used to determine a specific PI associated with a flowrate that matches the well test.

Conventional multilateral well testing is typically performed by first testing each individual lateral, such that only the tested lateral is open to flow. The individual PI values for each lateral are then correlated using the process described above. After testing all individual laterals, all laterals are opened to capture the overall production performance of the commingled multilateral well. However, when all laterals are open to flow, the measured stabilized flowing pressure does not provide any information about the contribution of each lateral which will be different than the individual lateral tests.

In contrast to conventional techniques, embodiments of the disclosure account for the interplay between laterals by altering the productivity index for each lateral by the same ratio. In such embodiments, the variance in strength between laterals is captured and the determination of the productivity index may be tuned based on the well and lateral test results in order to increase the accuracy of future well performance calculations.

Embodiments of the disclosure include a process for determining the productivity index of a multilateral completion using data from individual laterals and data from commingled well tests. The productivity index determination described in the disclosure considers the individual and multi-rate commingled test of the laterals and accounts for the interplay between laterals of the multilateral completion. The process for determining the productivity index of a multilateral completion includes 1) determining the productivity index for each single lateral by iteratively altering the productivity index until the individual lateral flowrate based on a known reservoir pressure is matched and 2) further determining the productivity index by iteratively altering the productivity index until the commingled flowrate is matched. The productivity index may be used to set wellhead pressures and inline control valve (ICV) settings for production. In some embodiments, a system for determining the productivity index of a multilateral completion is also provided.

FIG. 1 depicts a process 100 for determining the productivity indices for laterals of a multilateral completion in accordance with an embodiment of the disclosure. Initially, a multilateral well having multiple laterals extending from a main borehole (also referred to as a "main bore" or "motherbore" is selected (block 102). A well test may be performed on the multilateral well to determine initial productivity indices for each individual lateral using existing techniques known in the art (block 104). As used herein, the term "well test" refers to the measuring of a stabilized flowrate and wellbore flowing pressure under specific well test conditions that include a specific wellhead pressure. Other well test conditions may include, for example, a reservoir pressure and vertical flow correlation. The initial productivity index is then determined based on correlation with the well test results.

Next, as discussed further herein, individual lateral flowrate matching is performed on individual laterals using the flowrates from the well test data and flowrates calculated using a well model of the multilateral well to determine an intermediate productivity index by altering the initial productivity index for each lateral (block 106). Next, commingled flowrate matching (also referred to as "maximum production matching") is performed by opening all laterals using the flowrates from the well test data and flowrates calculated using a well model of the multilateral well to determine a final productivity index. The commingled flowrate matching is performed by reducing the intermediate productivity index for each lateral by the same percentage (that is, by the same fractional amount) and averaging the intermediate productivity index for each test (block 108).

Based on the final productivity index for each lateral, wellhead pressures (WHP), inline control valves (ICVs), or both may be adjusted to achieve a desired productivity from the multilateral completion (block 110). For example, an engineer at a well site may adjust the wellhead pressure at a wellhead of the multilateral well and may adjust the setting (e.g., between closed and 100% open) of one or more inline control valves to achieve a desired production rate (that is, a certain volume of produced fluid per time).

Figure 2:
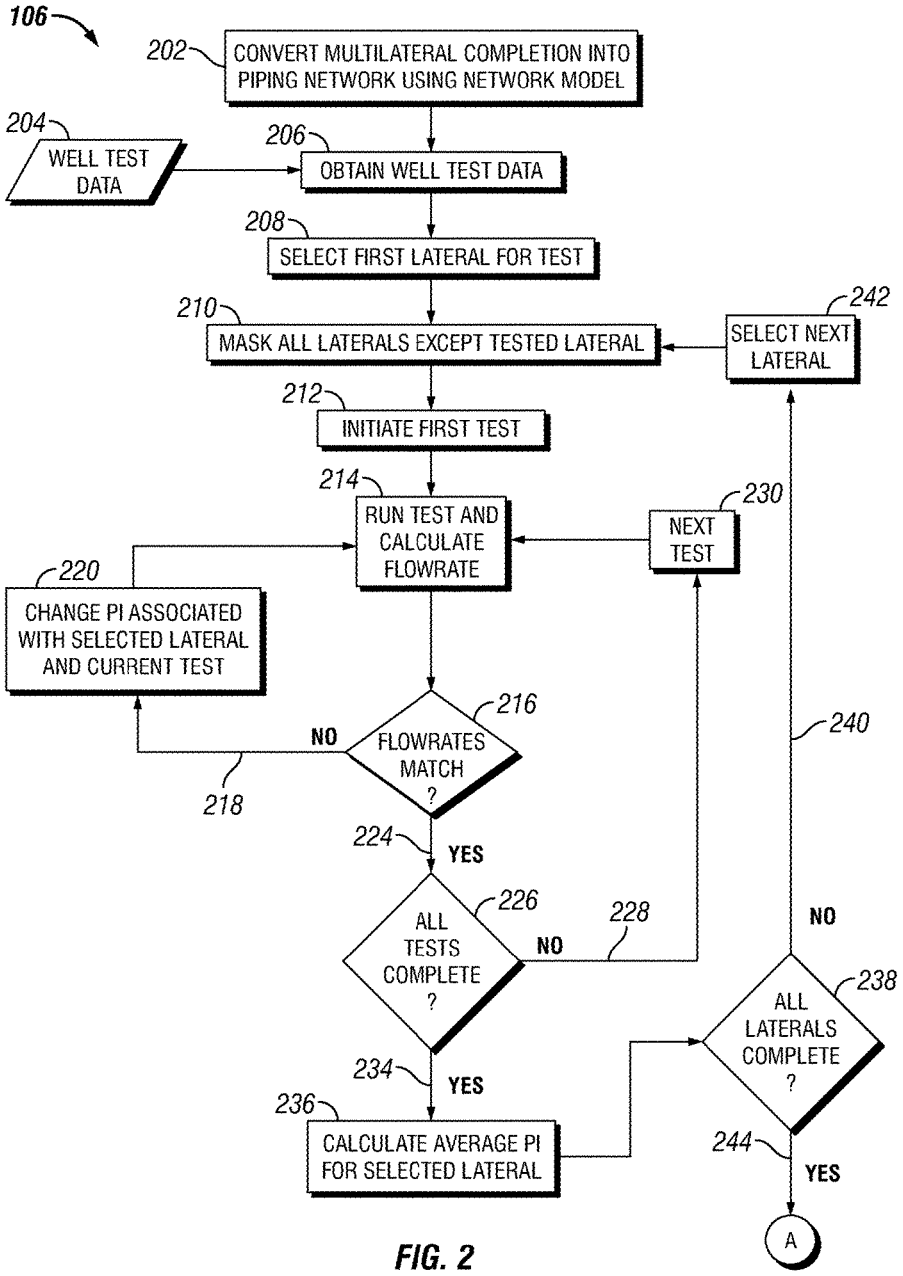
FIG. 2 is a block diagram of a process for performing individual lateral flowrate matching on individual laterals using the flowrates from the well test data and flowrates calculated using a well model of the multilateral well to determine an intermediate productivity index in accordance with an embodiment of the disclosure.

FIG. 2 further illustrates the process 106 for performing individual lateral flowrate matching on individual laterals using the flowrates from the well test data and flowrates calculated using a well model of the multilateral well to determine an intermediate productivity index. As discussed below, the intermediate productivity index may be determined by altering the initial productivity index for each lateral until the calculated flowrate from the well model matches the well test rate.

Initially, a network model (e.g., a piping network model) of the multilateral well and associated components (for example, tubing, intake control valves, the motherbore and the like) may be generated using a network modeling tool or flow simulator (block 202). For example, in some embodiments, a piping network model of the multilateral completion and associated components may be generated using GAP obtained from Petroleum Experts (Petex) of Edinburgh, Scotland, UK. In some embodiments, a piping network model of the multilateral completion and associated components may be generated using PIPESIM Steady-State Multiphase Flow Simulator obtained from Schlumberger Limited of Houston, Tex., USA. In other embodiments, other suitable network modeling tools or flow simulators may be used. In some embodiments, the network model may represent each lateral as a node associated with specific reservoir conditions and a productivity index.

As discussed above, well test data 204 may be obtained (block 206). The well test data may include, for example, stabilized flowrates and wellbore flowing pressures under a specific wellhead pressure. The well test data may include data from different tests having different conditions. For example, in some embodiments the well test data may include tests conducted at different inline control valve (ICV) settings. In one embodiment, the well test data may include tests conducted at 0% open, 33% open, and 100% open for each inline control valve and each permutation of these settings among all inline control valves. As discussed above, the well test data may include an initial productivity index associated with each lateral of the multilateral well.

Next, the first lateral of the selected multilateral completion may be selected for testing (block 208), such that all other laterals except the tested lateral are masked (block 210) in the network model such the laterals do not contribute to the flowrate calculations. For example, for a multilateral completion having two laterals, the first lateral may be selected and the second lateral may be masked in the network model. In another example, for a multilateral completion having three laterals, the first lateral may be selected and the second lateral and third lateral may be masked in the network model.

After masking all laterals except the tested lateral, the first test is initiated (block 212) using parameters associated with the test and the initial productivity index associated with the tested lateral. For example, the first test may include a setting (e.g., choke setting) of an inline control valve (ICV) associated with the tested lateral. It should be appreciated that a test may include other parameters such as wellhead pressures. The test is run on the selected lateral using the network model, and a flowrate is calculated for the selected test conditions (block 214). The calculated flowrate is compared to the well test flowrate to determine whether the flowrates match (block 216). For example, a "match" may include a numerical comparison of the flowrates to determine whether the values are within a threshold amount, such as within at least 0.5%, at least 1%, at least 1.5%, at least 2%, at least 2.5%, at least 3%, at least 3.5%, at least 4%, or at least 5%.

If the calculated flowrate does not match the well test flowrate (line 218), then the productivity index associated with the selected lateral is changed (block 220) and the current test is run again (block 214). For example, if the calculated flowrate is less than the well test flowrate, the productivity index associated with the selected lateral may be increased. In another example, if the calculated flowrate is greater than the well test flowrate, the productivity index associated with the selected lateral may be decreased. In this manner, the current test is run and the productivity index changed until a match between the calculated flowrate from the test and the well test flowrate is obtained (line 224).

If the calculated flowrate from the current test matches the well test flowrate for the test conditions, the process 106 determines whether all tests are complete (decision block 226). If all tests are not complete and there are additional tests (line 228), the next test is selected (block 230) and the test is run (block 214). For example, the next test may include another setting (e.g., choke setting) of an inline control valve (ICV) associated with the tested lateral and may include other parameters such as wellhead pressures different than the previous test. The flowrate of the test is calculated (block 214) and compared to the well test flowrate for the test conditions (decision block 216). The productivity index associated with the selected lateral is again changed (decision block 220) and the current test is run until the calculated flowrate matches the well test rate.

If all tests are complete (line 234), the average intermediate productivity index for the selected lateral is determined (block 236). For example, in embodiments having three tests run on a selected lateral, the average intermediate productivity index may be calculated from an average of the intermediate productivity index associated with the first test, the intermediate productivity index associated with the second test, and the productivity index associated with the third test.

The process 106 continues by determine whether all laterals of the multilateral well are complete (decision block 238), that is, whether all laterals have been selected and an intermediate productivity index determined. If all laterals are not complete (line 240), the next lateral of the multilateral well is selected (block 242) and all other laterals except the tested lateral are masked (block 210) to perform the testing and flowrate matching of the selected lateral as discussed in blocks 212-226. For example, for a multilateral completion having two laterals, the second lateral may be selected as the next lateral and the first lateral masked in the network model. In another example, for a multilateral completion having three laterals, the second lateral may be selected as the next lateral and the first lateral and third lateral may be masked in the network model.

Figure 3:
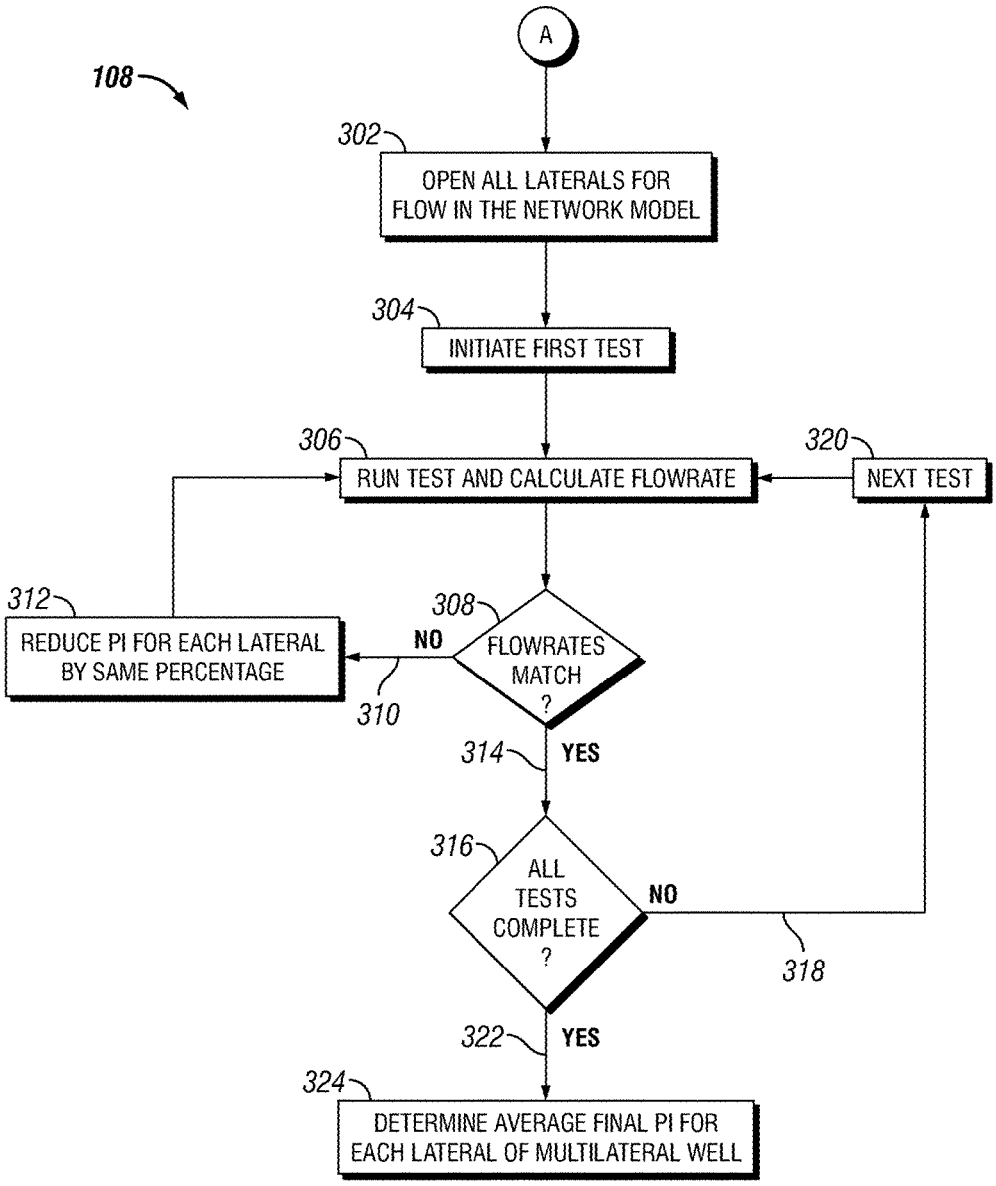
FIG. 3 is a block diagram of a process for commingled flowrate matching by opening all laterals in accordance with an embodiment of the disclosure.

If the individual testing of all laterals is complete (line 244) the process moves to the commingled flowrate matching depicted in block 108 of FIG. 1, as shown by connection block A in FIGS. 2 and 3. As discussed herein, the commingled flowrate matching is performed by opening all laterals in the network model and reducing the average intermediate productivity index for each lateral by the same percentage (that is, by the same fractional amount) until the commingled flowrates from the well test data matches the commingled flowrates calculated from the network model. A final productivity index for each lateral is determined by averaging the reduced productivity index (the productivity index at which the well test flowrate matches the calculated flowrate from the network model) for each test.

FIG. 3 further illustrates the process 108 for commingled flowrate matching by opening all laterals in accordance with embodiments of the disclosure. As discussed above and as shown by connection block A in FIGS. 2 and 3, the process 108 may be performed after the individual lateral flowrate matching on individual laterals and determination of an average intermediate productivity index discussed above.

Initially, all laterals are opened for flow in the network model (block 302). A first test is initiated (block 304) using parameters associated with the test and the average intermediate productivity index for each lateral. For example, the first test may include a setting (e.g., choke setting) of an inline control valve (ICV) associated with the tested lateral. It should be appreciated that a test may include other parameters such as wellhead pressures. The test is run using the network model, and a commingled flowrate is calculated for the selected test conditions (block 306).

The calculated commingled flowrate is compared to the well test commingled flowrate to determine whether the flowrates match (decision block 308). For example, a "match" may include a numerical comparison of the flowrates to determine whether the values are within a threshold amount, such as within at least 0.5%, at least 1%, at least 1.5%, at least 2%, at least 2.5%, at least 3%, at least 3.5%, at least 4%, or at least 5%. If the calculated flowrate does not match the well test flowrate (line 310), then the productivity index for each lateral is reduced by the same percentage (block 312) and the current test is run again and the flowrate is calculated (block 306). In this manner, the productivity index for each lateral is reduced by the same percentage until a match between the calculated flowrate from the test and the well test flowrate is obtained (line 314).

If the calculated flowrate from the current test matches the well test flowrate for the test conditions, the process 106 determines whether all tests are complete (decision block 316). If all tests are not complete and there are additional tests (line 318), the next test is selected (block 320) and the test is run (block 306). For example, the next test may include another setting (e.g., choke setting) of an inline control valve (ICV) associated with the one or more of the laterals and may include other parameters such as wellhead pressures different than the previous test. The flowrate for the test is calculated (block 306) and compared to the well test flowrate for the test conditions (decision block 308). The productivity index for each lateral and associated with the current test is reduced (block 312) and the current test is run until the calculated flowrate matches the well test rate (line 314).

If all tests are complete (line 322), the average final productivity index for the each lateral is determined (block 324). For example, in embodiments having three tests run on a selected lateral, the average final productivity index may be calculated from an average of the final productivity index associated with the first test, the final productivity index associated with the second test, and the final index associated with the third test.

In some embodiments, some portions of the process 102 may be implemented in a graphical user interface (GUI) of a well productivity evaluation system, such as the system described below and illustrated in FIG. 7. FIGS. 4-6 depict example elements of such a graphical user interface illustrating an example implementation of a process for determining the productivity indices for laterals of a multilateral completion in accordance with an embodiment of the disclosure.

FIG. 4 depicts a table 400 illustrating the parameters of various tests used in the process for determining the productivity indices for laterals of a multilateral completion in accordance with an embodiment of the disclosure. The table 400 depicts a description and the intake control valve settings for a main bore, first lateral ("L2"), and second lateral ("L3") of tests used in the process, as depicted in columns 402, 404, 406, and 408 respectively. Each row of the table 400 depicts a test and the inline control valve settings associated with the test. In the embodiments shown in FIG. 4, the tests are based on permutations of 100% open, 33% open, and closed (0% open) for each inline control valve. The depicted tests, shown in order in rows 410, 412, 414, 416, 418, and 420 are: all ICVs 100% open; Toggle 33% on one ICV; toggle 33% on two ICVs, shut the motherbore and run all ICV combination, shut Lateral 1 (L2) and run all ICV combinations, and shut Lateral 2 (L3) and run all ICV combinations. In some embodiments, the tests may be predetermined based on permutations of different combinations (for example, permutations on three combinations of 0, 33$ and 100% open) for each lateral. In some embodiments, as shown in row 422, a user may select specific ICV settings for a test. For example, the test shown in row 422 has an MB ICV setting of 100%, an L2 ICV setting of 100% and an L3 ICV setting of 5.29%.

FIG. 5 depicts a table 500 illustrating the outputs from a process for determining the productivity indices for laterals of a multilateral completion in accordance with an embodiment of the disclosure. The table 500 depicts a description of the tests and corresponding ICV settings in columns 502, 504, 506, and 508 used in the process. In some embodiments, the oil, gas/oil ratio (GOR), and water cut (WC) for the multilateral well, the main bore, and each lateral are displayed for each test in a respective row. In some embodiments, for example, each test may be performed sequentially to calculate the outputs in the table. Accordingly, as shown in table 500, the following outputs are shown in columns 510, 512, 514, 516, 518, 520, 522, 524, and 526 respectively: Well Oil, Well GOR, Well WC, MB Oil, L1 Oil, L2 Oil, MB GOR, L1 GOR, and L2 GOR. Each test corresponds to a row in the table 500, in a similar manner to the table 400. For example, the depicted tests, shown in order in rows 528, 530, 532, 534, 536, and 538 are: all ICVs 100% open; Toggle 33% on one ICV; toggle 33% on two ICVs, shut the motherbore and run all ICV combination, shut Lateral 1 (L2) and run all ICV combinations, and shut Lateral 2 (L3) and run all ICV combinations. In some embodiments, as discussed above and as shown in row 540, a user may select specific ICV settings for a test different than the specified permutations. For example, the test shown in row 540 has an MB ICV setting of 100%, an L2 ICV setting of 100% and an L3 ICV setting of 5.29%.

FIG. 6 depicts an example GUI element 600 illustrating the outputs from the process for determining the productivity indices for laterals of a multilateral completion in accordance with an embodiment of the disclosure. The example GUI element illustrates outputs for a multilateral completion having a main bore and three laterals (identified as L1, L2 and L3). In some embodiments, the GUI element 600 may include input boxes 602 that enable a user to specify a constraint in the performance of the process for determining the productivity indices for laterals of the multilateral completion. In the example shown in FIG. 6, a constraint of 5200 barrels/day (bbls/d) of maximum oil is specified. The GUI element 600 may include status boxes 606 that display information about the tested multilateral, such as separator name, well name, number (no.) of laterals, main bore name, lateral 1 name, lateral 2 name, and so on.

The GUI element 600 may include user-selectable elements (e.g., buttons) that provide for the execution of various actions by, for example, a well productivity evaluation system. For example, a button 608 may enable a user to run all tests upon selection of the button 608. In another example, a button 610 may enable a user to set constraints in the pipe modeling or flow simulator tool used to model the laterals.

The GUI element further includes the table 500 discussed above that provides the outputs from the process for determining the productivity indices for laterals of a multilateral completion. The values in the table 500 in FIG. 6 illustrate the impact of shutting each lateral as well as toggling the laterals at a 33% ICV opening (that is, a 33% choke). In the example multilateral completion shown in FIG. 6, the L3 ICV contributes the majority of the production. Consequently, the L3 IV position is gradually reduced while the MB ICV and L2 ICV remain 100% open. When the L3 ICV is set to 5.29% (as shown in the last row 540 of the table 500), the contribution of the L3 ICV is reduced.

Figure 7:
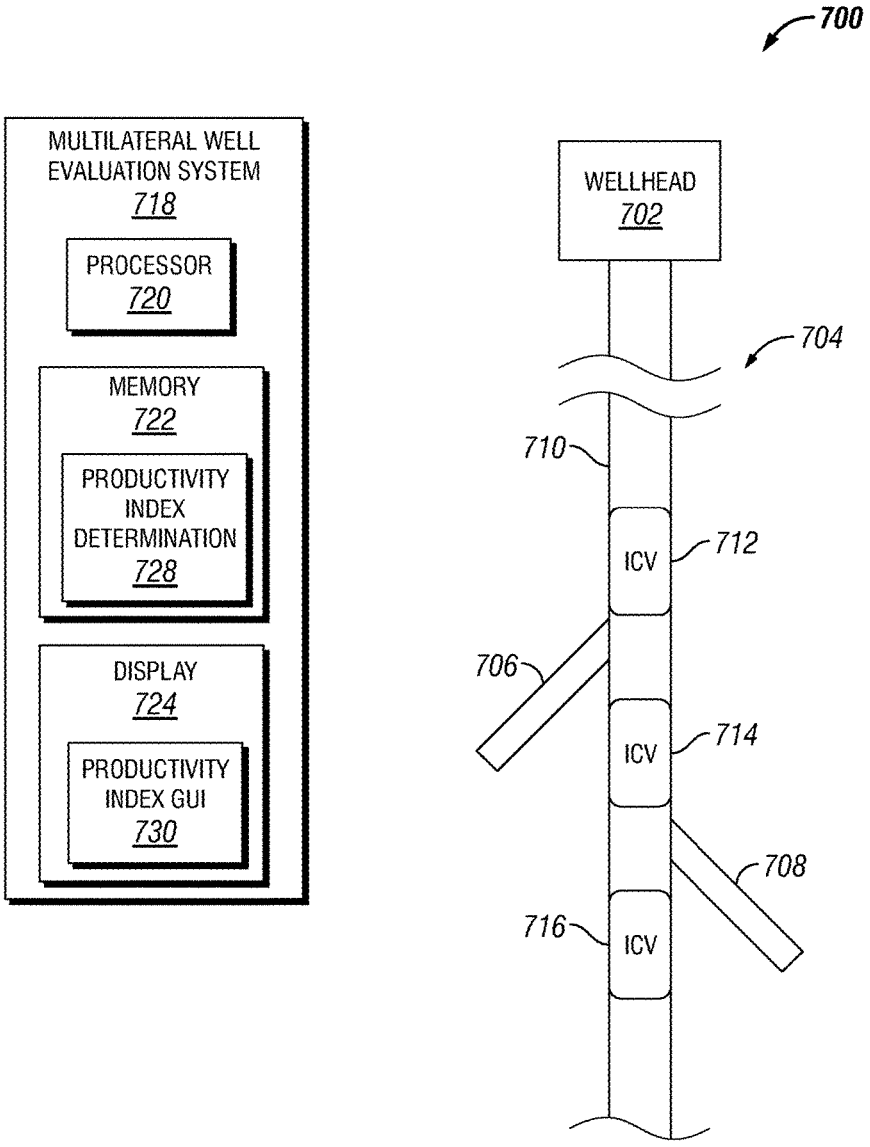
FIG. 7 is a schematic diagram of a well site for a multilateral completion and a multilateral completion evaluation system in accordance with an embodiment of the disclosure.

FIG. 7 is a schematic diagram of a well site 700 having a wellhead 702 for a multilateral completion 704 (that is, a completed multilateral well) having a first lateral 706, a second lateral 708, and a motherbore 710. FIG. 7 also depicts a first ICV 712, a second ICV 714, and a third ICV 716 disposed in the multilateral completion 704. As will be appreciated, the wellhead 702 may control the production of hydrocarbons from the multilateral completion 704 via various functionalities and components known in the art. The ICV's 712, 714, and 716, may control the flowrate of produced hydrocarbons from various segments of the multilateral completion 704. For example, the ICV 714 may be used to control the flowrate of hydrocarbons from the second lateral 708.

In some embodiments, a multilateral well evaluation system 718 may be used to evaluate the performance of the multilateral completion 704 using the techniques described herein. The multilateral well evaluation system 718 may further be used to provide for the adjustment of wellhead pressures in the wellhead 702 and the adjustment of the ICV's 712, 714, and 716.

In some embodiments, the multilateral well evaluation system 718 may include a processor 720, a memory 722, and a display 724. It should be appreciated that the multilateral well evaluation system 718 may include or be coupled other components not shown in FIG. 7, such as input devices, network devices, and so on.

FIG. 7 also depicts components of a multilateral well evaluation system 718 in accordance with an embodiment of the disclosure. In some embodiments, multilateral well evaluation system 718 may be in communication with components that obtain or process data from the well 704 (for example, such as well test data). As shown in FIG. 7, the multilateral well evaluation system 718 may include a productivity index processor 720, a memory 722, and a display 724. It should be appreciated that the multilateral well evaluation system 718 may include other components that are omitted for clarity, such as a network interface, input device, etc.

The productivity index processor 720 (as used the disclosure, the term "processor" encompasses microprocessors) may include one or more processors having the capability to receive and process seismic data, such as data received from seismic receiving stations. In some embodiments, the productivity index processor 720 may include an application-specific integrated circuit (AISC). In some embodiments, the productivity index processor 720 may include a reduced instruction set (RISC) processor. Additionally, the productivity index processor 720 may include a single-core processors and multicore processors and may include graphics processors. Multiple processors may be employed to provide for parallel or sequential execution of one or more of the techniques described in the disclosure. The productivity index processor 720 may receive instructions and data from a memory (for example, memory 722).

The memory 722 (which may include one or more tangible non-transitory computer readable storage mediums) may include volatile memory, such as random access memory (RAM), and non-volatile memory, such as ROM, flash memory, a hard drive, any other suitable optical, magnetic, or solid-state storage medium, or a combination thereof. The memory 722 may be accessible by the productivity index processor 720. The memory 722 may store executable computer code. The executable computer code may include computer program instructions for implementing one or more techniques described in the disclosure. For example, the executable computer code may include productivity index determination instructions 728 to implement one or more embodiments of the present disclosure. In some embodiments, the productivity index determination instructions 728 may implement one or more elements of the processes 106 and 108 described above and illustrated in FIGS. 2 and 3. In some embodiments, the productivity index determination instructions 728 may receive, as input, well test data and provide, as output, productivity indices for multilateral well (for example, a productivity index for the main bore 710, the first lateral 706, and the second lateral 708). The productivity indices may be stored in the memory 722.

The display 724 may include a cathode ray tube (CRT) display, liquid crystal display (LCD), an organic light emitting diode (OLED) display, or other suitable display. The display 724 may display a user interface (for example, a graphical user interface) that may display information received from the multilateral well evaluation system 718. In accordance with some embodiments, the display 724 may be a touch screen and may include or be provided with touch sensitive elements through which a user may interact with the user interface. In some embodiments, the display 724 may display a productivity index GUI 730 described above and illustrated in FIGS. 4-6. The display 724 may display, for example, productivity indices for the multilateral completion 704 determined according to the techniques described herein.

In some embodiments, the multilateral well evaluation system 718 may include a network interface that may provide for communication between the multilateral well evaluation system 718 and other devices. The network interface may include a wired network interface card (NIC), a wireless (e.g., radio frequency) network interface card, or combination thereof. The network interface may include circuitry for receiving and sending signals to and from communications networks, such as an antenna system, an RF transceiver, an amplifier, a tuner, an oscillator, a digital signal processor, and so forth. The network interface may communicate with networks, such as the Internet, an intranet, a wide area network (WAN), a local area network (LAN), a metropolitan area network (MAN) or other networks. Communication over networks may use suitable standards, protocols, and technologies, such as Ethernet Bluetooth, Wireless Fidelity (Wi-Fi) (e.g., IEEE 802.11 standards), and other standards, protocols, and technologies.

In some embodiments, the multilateral well evaluation system 718 may include or be coupled to one or more input devices. The input devices may include, for example, a keyboard, a mouse, a microphone, or other input devices. In some embodiments, the input devices may enable interaction with a user interface displayed on the display 724.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described herein. It is to be understood that the forms shown and described herein are to be taken as examples of embodiments. Elements and materials may be substituted for those illustrated and described herein, parts and processes may be reversed or omitted, and certain features may be utilized independently, all as would be apparent to one skilled in the art after having the benefit of this description. Changes may be made in the elements described herein without departing from the spirit and scope of the disclosure as described in the following claims. Headings used herein are for organizational purposes only and are not meant to be used to limit the scope of the description.

What is claimed is:

1. A method for determining the productivity of a multilateral completion having a plurality of laterals, comprising:

determining a plurality of initial productivity indices associated with the plurality of laterals and a plurality of well tests, each of the plurality of well tests associated with a set of well test conditions, the well test conditions comprising a wellhead pressure and a well test flowrate;

determining a respective plurality of intermediate productivity indices associated with the plurality of laterals, wherein determining the intermediate productivity index associated with a selected lateral of the plurality of laterals comprises:

determining, for each of the plurality of well tests, a modeled flowrate for the selected lateral using the well test conditions associated with a first selected well test; and iteratively modifying, for each of the plurality of well tests, the initial productivity index associated with the selected lateral until the well test flowrate of the first selected well test matches the modeled flowrate;

determining the intermediate productivity index associated with the selected lateral from an average of the modified initial productivity index for each of the plurality of well tests;

determining a respective plurality of final productivity indices associated with the plurality of laterals, wherein determining the final productivity index for the selected lateral comprises:

determining, for each of a second plurality of well tests, a modeled commingled flowrate using the respective plurality of intermediate productivity indices associated with the plurality of laterals and the well test conditions associated with a second selected well test;

iteratively reducing, for each of the second plurality of well tests, the respective intermediate productivity index for each of the plurality laterals by an identical percentage until a well test commingled flowrate of the second selected well test matches the modeled commingled flowrate; and determining the final productivity index for the selected lateral from an average of the reduced intermediate productivity index for each of the plurality of well tests.

2. The method of claim 1, comprising adjusting a wellhead pressure of a wellhead associated with the multilateral completion based on one or more of the respective plurality of final productivity indices for the plurality of laterals.

3. The method of claim 1, wherein the multilateral completion comprises a plurality of inline control valves, the method comprising adjusting at least one of the plurality of inline control valves based on one or more of the respective plurality of final productivity indices for the plurality of laterals.

4. The method of claim 1, the well test conditions comprising a reservoir pressure of the multilateral completion and a vertical flow correlation of the multilateral completion.

5. The method of claim 1, comprising generating a network model of the multilateral completion, wherein the modeled commingled flowrate is determined from the network model.

6. The method of claim 5, wherein determining, for each of the plurality of well tests, the modeled flowrate for the selected one of the plurality of laterals comprises masking the unselected laterals of the plurality of laterals in the network model such that the unselected laterals do not contribute to the modeled flowrate determination.

7. A system for determining the productivity of a multilateral completion having a plurality of laterals, comprising:

a productivity index processor;

a non-transitory computer-readable memory accessible by the productivity index processor, the memory having executable code stored thereon, the executable code comprising a set of instructions that causes the processor to perform operations comprising:

determining a plurality of initial productivity indices associated with the plurality of laterals and a plurality of well tests, each of the plurality of well tests associated with a set of well test conditions, the well test conditions comprising a wellhead pressure and a well test flowrate;

determining a respective plurality of intermediate productivity indices associated with the plurality of laterals, wherein determining the intermediate productivity index associated with a selected lateral of the plurality of laterals comprises:

determining, for each of the plurality of well tests, a modeled flowrate for the selected lateral using the well test conditions associated with a first selected well test; and iteratively modifying, for each of the plurality of well tests, the initial productivity index associated with the selected lateral until the well test flowrate of the first selected well test matches the modeled flowrate;

determining the intermediate productivity index associated with the selected lateral from an average of the modified initial productivity index for each of the plurality of well tests;

determining a respective plurality of final productivity indices associated with the plurality of laterals, wherein determining the final productivity index for the selected lateral comprises:

determining, for each of a second plurality of well tests, a modeled commingled flowrate using the respective plurality of intermediate productivity indices associated with the plurality of laterals and the well test conditions associated with a second selected well test;

iteratively reducing, for each of the second plurality of well tests, the respective intermediate productivity index for each of the plurality laterals by an identical percentage until a well test commingled flowrate of the second selected well test matches the modeled commingled flowrate; and determining the final productivity index for the selected lateral from an average of the reduced intermediate productivity index for each of the plurality of well tests.

8. The system of claim 7, comprising the multilateral completion.

9. The system of claim 8, wherein the multilateral completion comprises a plurality of inline control valves and a wellhead.

10. The system of claim 9, wherein the wellhead pressure of the wellhead is adjusted based on one or more of the respective plurality of final productivity indices for the plurality of laterals.

11. The system of claim 9, wherein at least one of the plurality of inline control valves is adjusted based on one or more of the respective plurality of final productivity indices for the plurality of laterals.

12. The system of claim 7, the well test conditions comprising a reservoir pressure of the multilateral completion and a vertical flow correlation of the multilateral completion.

13. The system of claim 7, the operations comprising generating a network model of the multilateral completion, wherein the modeled commingled flowrate is determined from the network model.

14. The system of claim 7, wherein determining, for each of the plurality of well tests, the modeled flowrate for the selected one of the plurality of laterals comprises masking the unselected laterals of the plurality of laterals in the network model such that the unselected laterals do not contribute to the modeled flowrate determination.

15. A non-transitory computer-readable medium having executable code stored thereon for or determining the productivity of a multilateral completion having a plurality of laterals, the executable code comprising a set of instructions that causes a processor to perform operations comprising:

determining a plurality of initial productivity indices associated with the plurality of laterals and a plurality of well tests, each of the plurality of well tests associated with a set of well test conditions, the well test conditions comprising a wellhead pressure and a well test flowrate;

determining a respective plurality of intermediate productivity indices associated with the plurality of laterals, wherein determining the intermediate productivity index associated with a selected lateral of the plurality of laterals comprises:

determining, for each of the plurality of well tests, a modeled flowrate for the selected lateral using the well test conditions associated with a first selected well test; and iteratively modifying, for each of the plurality of well tests, the initial productivity index associated with the selected lateral until the well test flowrate of the first selected well test matches the modeled flowrate;

determining the intermediate productivity index associated with the selected lateral from an average of the modified initial productivity index for each of the plurality of well tests;

determining a respective plurality of final productivity indices associated with the plurality of laterals, wherein determining the final productivity index for the selected lateral comprises:

determining, for each of a second plurality of well tests, a modeled commingled flowrate using the respective plurality of intermediate productivity indices associated with the plurality of laterals and the well test conditions associated with a second selected well test;

iteratively reducing, for each of the second plurality of well tests, the respective intermediate productivity index for each of the plurality laterals by an identical percentage until a well test commingled flowrate of the second selected well test matches the modeled commingled flowrate; and determining the final productivity index for the selected lateral from an average of the reduced intermediate productivity index for each of the plurality of well tests.

16. The non-transitory computer-readable medium of claim 15, the well test conditions comprising a reservoir pressure of the multilateral completion and a vertical flow correlation of the multilateral completion.

17. The non-transitory computer-readable medium of claim 15, comprising generating a network model of the multilateral completion, wherein the modeled commingled flowrate is determined from the network model.

18. The non-transitory computer-readable medium of claim 17, wherein determining, for each of the plurality of well tests, the modeled flowrate for the selected one of the plurality of laterals comprises masking the unselected laterals of the plurality of laterals in the network model such that the unselected laterals do not contribute to the modeled flowrate determination.

19. The non-transitory computer-readable medium of claim 15, wherein the multilateral completion comprises a plurality of inline control valves and a wellhead.

20. The non-transitory computer-readable medium of claim 15, the operations comprising providing a graphical user interface on a display coupled to the processor, the graphical user interface comprising a user interface element that includes the final productivity index.

* * * * *